United States Patent [19]

Eich et al.

[11] 3,933,178

[45] Jan. 20, 1976

[54] METERING APPARATUS FOR LIQUIDS CONTAINING GRANULAR SOLIDS, IN PARTICULAR LAPPING LIQUID

[75] Inventors: Edmund Eich; Ewald Weber; Heinz Gerner, all of Coburg; Rudolf Merkel, Coburg-Scheuerfeld, all of Germany

[73] Assignee: Werkzeugmaschinenfabrik Adolf Waldrich Coburg, Coburg, Germany

[22] Filed: Sept. 9, 1974

[21] Appl. No.: 504,532

[30] Foreign Application Priority Data

Sept. 14, 1973 Germany ..... 2346325

[52] U.S. Cl. ..... 137/608; 137/590

[51] Int. Cl.[2] ..... F17D 3/10

[58] Field of Search ..... 302/59, 61, 16; 51/263, 51/264, 317; 137/561 R, 561 A, 262, 590, 608

[56] References Cited

UNITED STATES PATENTS

| | | | |
|---|---|---|---|
| 2,164,011 | 6/1939 | Hilborn | 137/561 A |
| 2,716,509 | 8/1955 | Saul | 222/173 |
| 3,428,083 | 2/1969 | Fish | 137/262 X |
| 3,643,689 | 2/1972 | Isreeli et al. | 137/561 A |

*Primary Examiner*—Robert B. Reeves
*Assistant Examiner*—John P. Shannon
*Attorney, Agent, or Firm*—Woodhams, Blanchard and Flynn

[57] ABSTRACT

A metering apparatus for liquids containing granular solids, in particular lapping liquid. The stream of liquid issuing from the feed pipe is conveyed with a wide area against a substantially vertical wall, to run down thereon in the form of a thin film of uniform thickness. The collecting pipe is arranged on the side of the wall which is remote from the liquid film. The wall has an orifice therethrough in its lower zone for the free end of the collecting pipe which extends obliquely upwardly. The collecting opening has a cross section which widens with progressive movement of the collecting pipe through the orifice.

11 Claims, 5 Drawing Figures

15
1a
2
3
1b
4
II
A
II
5
11
12
7
7a
6
1
8
9
10

METERING APPARATUS FOR LIQUIDS CONTAINING GRANULAR SOLIDS, IN PARTICULAR LAPPING LIQUID

FIELD OF THE INVENTION

This invention relates to a metering apparatus for liquids containing granular solids, in particular lapping liquid, wherein the metering of the liquid is effected by a collecting pipe adjustable transversely of a stream of liquid issuing from a feed pipe, the collecting pipe having its collecting opening disposed transversely of the stream of liquid immersed in this stream to a greater or lesser degree.

BACKGROUND OF THE INVENTION

In a known metering apparatus of this kind for lapping medium, the desired amount of liquid is withdrawn from a stream of liquid flowing in laminar form in a free jet by the collecting pipe having its collecting opening immersed in the stream of liquid to a predetermined depth. Since, however, this immersion is effected from the outer boundary of the stream of liquid and this outer boundary may shift during such withdrawal as a result of possible variations in the state of flow of the liquid, this method does not enable the adjusted metering to be maintained.

Metering devices are also known in which the metering is effected via a throttling element which is installed in the feed line and which must be adjusted at any given time to the quantity to be metered and to the consistency of the lapping medium. The lapping powder, however, produces an erosion at the narrow parts of the throttling element, which alters the adjustment thereof and, moreover, renders exchange of the throttling element necessary after a certain time. Furthermore, throttling elements have a tendency to become blocked, depending upon the size of the grains of the lapping powder employed, which necessitates a costly device for keeping the bores of the throttling elements clear.

The problem underlying the invention is to provide a metering apparatus of the kind mentioned at the beginning which renders possible accurate and reliable, as well as trouble-free, metering of liquids containing granular solids, in particular lapping liquid.

According to the invention, this is achieved in that the stream of liquid issuing from the feed pipe is conveyed with a wide area against a substantially vertical wall, to run down thereon in the form of a thin film of uniform thickness, the collecting pipe is arranged essentially on that side of the wall which is remote from the liquid film, the wall has a through orifice in its lower zone for the free end extending obliquely upwards of the collecting pipe, and the collecting opening has a cross-section which widens with progressive movement of the collecting pipe into the through orifice.

Since the liquid is conveyed with a wide area on to the vertical wall, a uniform distribution of the liquid in the form of a thin liquid film takes place at this wall. The thickness of this liquid film is scarcely subject to variation. The collecting opening of the collecting pipe "cuts out" of the liquid film a strip whose width is dependent upon that cross-section of the collecting opening which is located at any given time in the region of the wall. In this way, a very simple and trouble-free metering apparatus is created which enables accurate metering of the liquid, in particular a lapping liquid.

There has been found to be particularly advantageous a metering apparatus wherein the wall is formed by a cylindrical casing with a vertical axis into which the coaxially arranged feed pipe extends from above, the lower end of the feed pipe being arranged at a distance from a horizontal coaxial impingement plate by which the liquid is conveyed radially outwards against the inner face of the cylindrical casing. By means of the impingement plate, the stream of liquid is converted into an umbrella-shaped curtain of liquid and deflected radially outwards. The curtain of liquid striking against the inner face of the cylindrical casing forms thereon a thin liquid film of uniform thickness.

BRIEF DESCRIPTION OF THE DRAWINGS

The invention is described more fully hereinafter with reference to embodiments illustrated in the drawings. In these drawings.

DETAILED DESCRIPTION

Figure 1:
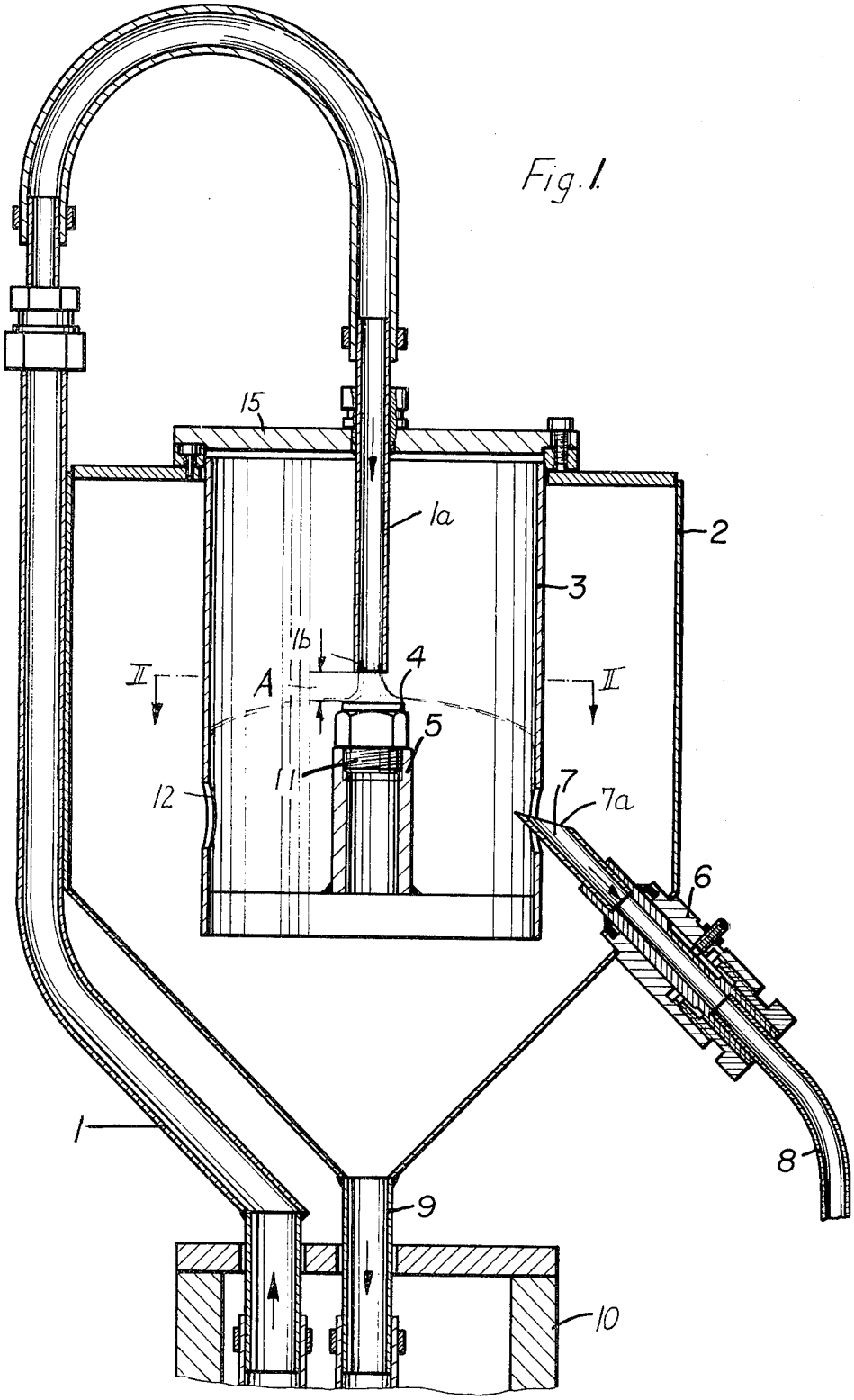
FIG. 1 is an axial section through a first embodiment.

Lapping liquid is delivered from a supply tank 10 through piping 1 into a vertical feed pipe 1*a*. This feed pipe 1*a* is surrounded concentrically by a cylindrical casing 3. Arranged at a distance from the lower end 1*b* of the feed pipe 1*a* is a horizontal impingement plate 4. The distance A between the lower end 1*b* of the feed pipe 1*a* and the impingement plate 4 is advantageously adjustable. Moreover, the impingement plate 4 consists with advantage of material which is resistant to erosion by lapping medium, such as, for example, polytetrafluoroethylene, which is known under the trade mark "Teflon". Since even such material is subject to erosion after lengthy use, the impingement plate should be exchangeable.

To this end, the impingement plate 4 is arranged on the head of a bolt 11. By screwing this bolt 11 out of the holder 5 and replacing the bolt by a bolt with a new impingement plate, rapid exchange is possible.

Beyond the outer periphery of the cylindrical casing 3 a plurality of collecting pipes 7 uniformly distributed at the periphery are advantageously provided and in the embodiment shown there are four of these pipes. These collecting pipes can be shifted axially by means of an adjusting device 6. Each of them has a collecting opening 7*a*. A through orifice 12 is provided in the cylindrical casing 3 for each of the collecting pipes. The free end of a collecting pipe also extends into the through orifice 12 shown on the left in FIG. 1, but the collecting pipe is not shown for reasons of clarity, and the piping 1 is shown displaced by a few degrees.

Figure 2:
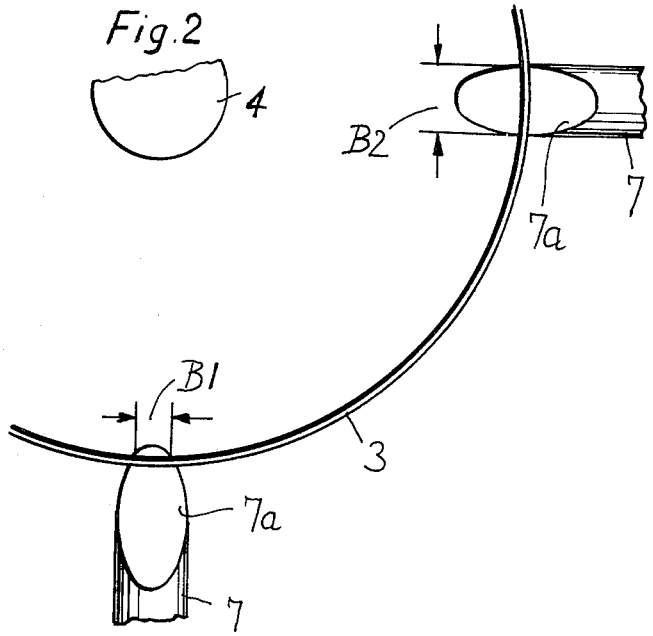
FIG. 2 is a radial section on the line II—II in FIG. 1.

As can be seen from FIG. 2, the collecting opening 7*a* has a cross-section which widens with progressive movement of the collecting pipe 7 into the through orifice 12. In the embodiment shown, the collecting pipe 7 has a circular cross-section and the collecting opening 7*a* has an elliptical cross-section which is formed by cutting the pipe off obliquely. If necessary, however, the collecting pipe or at least the end thereof could have a different cross-section, for example a triangular cross-section.

The new metering apparatus operates in the following manner:

The stream of liquid issuing from the feed pipe 1*a* strikes against the impingement plate 4 and is converted by it into an umbrella-shaped curtain of liquid which is symmetrical with respect to the impingement plate and has a radial direction of flow. This curtain of liquid strikes against the inner face of the cylindrical casing and runs down it in the form of a continuous thin liquid film of uniform thickness.

The thickness of this liquid film is only a few hundredths of a millimeter. This liquid film also continues in the region of the through orifices 12 and, in designing the through orifices, it is necessary to take care that they do not have too large a cross-section and are also so formed at their edges that the liquid film is not interrupted. As can be seen in particular from FIG. 2, which shows the collecting pipes in two different positions, the collecting opening "cuts out" of the liquid film a strip whose width B1 and B2, respectively, is dependent upon the particular position of the collecting pipe. The amount of liquid picked up by the collecting pipe is consequently clearly defined by the thickness of the liquid film times the width B1 or B2 which is determined by the cross-section of the collecting opening located at any given time in the region of the cylindrical casing 3. The liquid picked up by the collecting pipes is then supplied to the treating or working station via the piping 8. The amounts of liquid picked up by the four collecting pipes may be supplied to four different treating stations, but it is also conceivable to introduce the amounts of liquid picked up by the four collecting pipes into a common conduit and supply them to the treating station. This arrangement would have the advantage that even slight variations in the thickness of the film which might occur in certain circumstances at the inner face of the cylindrical casing are completely compensated. The liquid not picked up by the collecting pipes is collected by the collecting receptacle 2 and flows back through the pipe 9 into the supply tank 10.

The extent of the curtain of liquid deflected by the impingement plate 4 is dependent upon the velocity of impact and the pressure of the liquid flowing out of the feed pipe 1*a*. It must always be of such a size that the cylindrical casing 3 is wetted above the through orifices 12. The pressure and the flow velocity of the liquid are dependent, however, on its viscosity, the delivery pressure of the pump and the distance A between the lower end 1*b* of the pipe and the impingement plate 4. By shifting the feed pipe 1*a* and, if necessary, also the impingement plate 4 axially, the height of the free stream of liquid can be varied and the metering apparatus be thereby adapted to the various working conditions.

Figure 3:
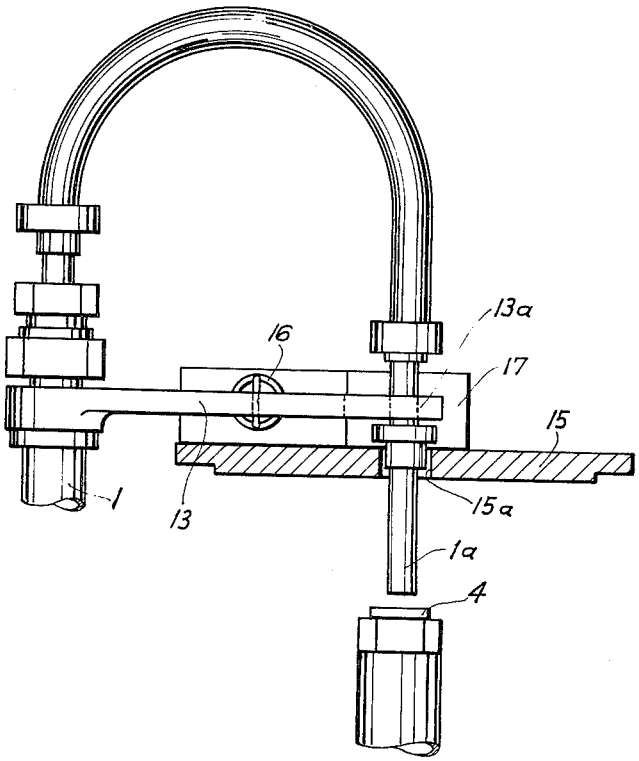
FIG. 3 is a partial axial section through a second embodiment.
Figure 4:
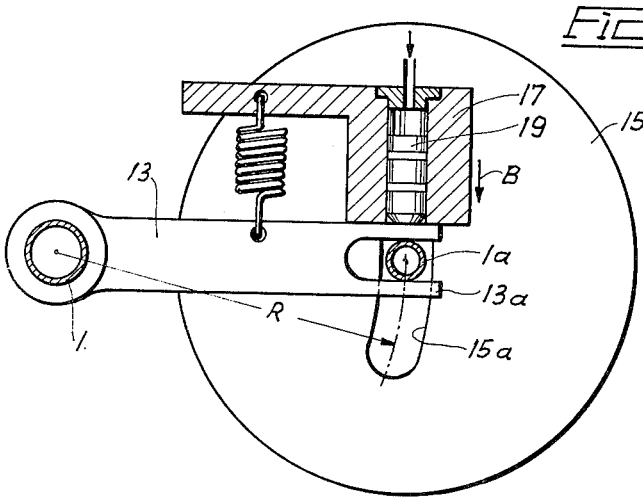
FIG. 4 is a section on the line IV—IV in FIG. 3.

The flow of liquid to the treating or working station must often be interrupted suddenly, for example when a workpiece is changed. For this purpose, the pump could be turned off, but this would have the disadvantage of liquid continuing to flow or drip and reaching the treating station immediately on recommencement of the work. For this reason, it is advantageous that the feed pipe 1*a* be arranged to be swung away parallel to itself out of the range of the impingement plate 4, in accordance with the embodiment shown in FIGS. 3 and 4. To this end, a slot 15*a* of radius R is provided in the cover 15 which closes the cylindrical casing 3 at the top. Mounted on the pipe 1 for rotation about a vertical axis is a swing lever 13, the end 13*a* of which embraces the feed pipe 1*a* in the form of a fork. The swing lever is forced by means of a spring 16 against a stop 17. This stop serves to fix the coaxial position of the feed pipe 1*a* and the impingement plate 4. It may itself also be adjustable. Arranged in the stop is a piston 19 which can be shifted pneumatically or hydraulically when the flow of liquid is to be interrupted. On shifting of the piston in the direction B, the feed pipe is swung away out of the range of the impingement plate 4 and the liquid can consequently flow off downwardly unimpeded directly into the collecting receptacle 2.

Figure 5:
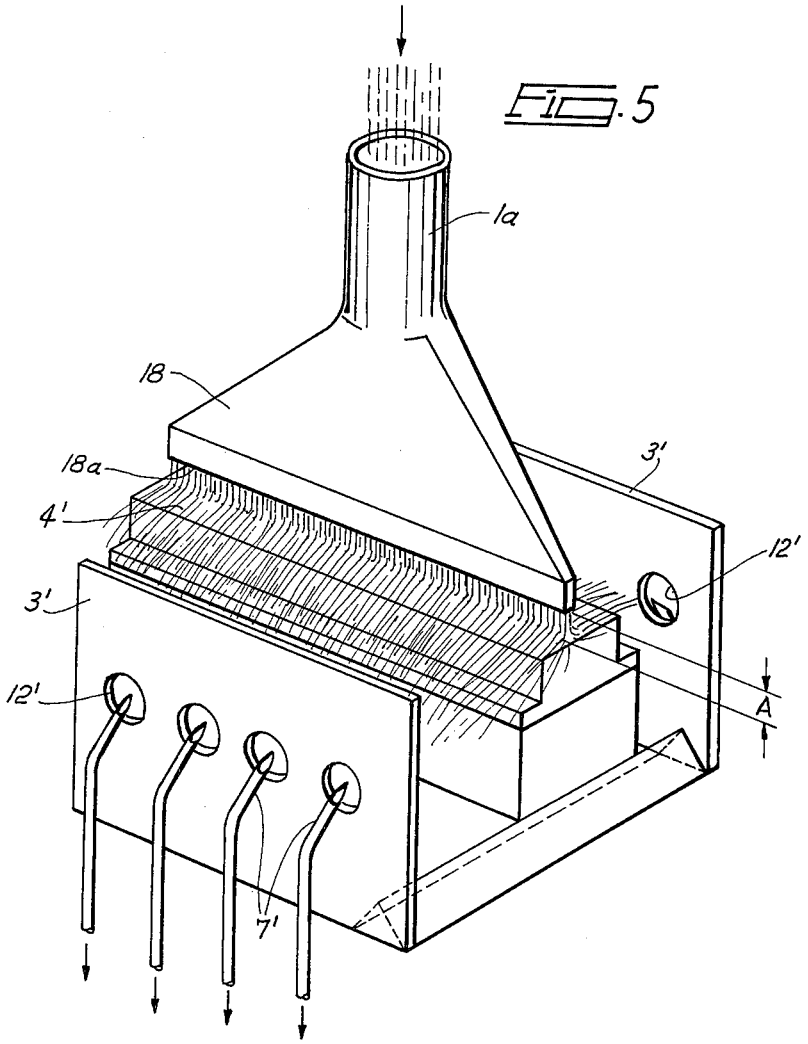
FIG. 5 shows another embodiment.

FIG. 5 shows another embodiment in which a broad-band nozzle 18 of rectangular cross-section is provided at the end of the feed pipe 1*a*. The lower end 18*a* of the broad-band nozzle is arranged at a distance A from a horizontal rectangular impingement plate 4', by which the liquid is directed outwardly perpendicularly to the longitudinal sides of the nozzle and the impingement plate against two plane and vertical walls 3' arranged on both sides of the impingement plate at a distance therefrom. A plurality of through orifices 12' through which the collecting pipes 7' extend are provided side by side in the walls 3'. The mode of operation is basically the same as that of the embodiment according to FIGS. 1 and 2.

We claim:

1. A metering apparatus for liquids containing granular solids, in particular lapping liquid, comprising: a collecting pipe adjustable transversely of a stream of liquid issuing from a feed pipe for the metering of the liquid, said collecting pipe having its collecting opening disposed transversely of the stream of liquid and immersed therein, converting means for converting said stream of liquid issuing from said feed pipe over a wide area against a substantially vertical wall to run down thereon in the form of a thin film of uniform thickness, said collecting pipe being arranged essentially on a side of the wall which is remote from said liquid film, said wall having a through orifice therein in its lower zone for receiving a free end of said collecting pipe therein, said free end extending upward of said collecting pipe, said collecting opening having a cross-section which widens with progressive movement of said collecting pipe into said through orifice.

2. A metering apparatus according to claim 1, wherein said collecting pipe has a circular cross-section and said collecting opening has an elliptical cross-section which is formed by cutting the pipe off obliquely at said free end thereof.

3. A metering apparatus according to claim 1 including adjusting means for adjusting said collecting pipe in the direction of its axis.

4. A metering apparatus according to claim 1, wherein said wall is formed by a cylindrical casing having a vertical axis and coaxially receiving said feed pipe from above, the lower end of said feed pipe being arranged at a distance (A) from a horizontal coaxial impingement plate defining said converting means, said impingement plate causing said liquid to be conveyed radially outward against the inner face of said cylindrical casing.

5. A metering apparatus according to claim 4, including variable means for varying said distance (A) between the lower end of said feed pipe and said impingement plate.

6. A metering apparatus according to claim 4, including a plurality of collecting pipes uniformly distributed at the outer periphery of said cylindrical casing, said collecting pipes extending through corresponding through orifices in said cylindrical wall.

7. A metering apparatus according to claim 4, wherein said impingement plate is exchangeable by being arranged on the head of a bolt.

8. A metering apparatus according to claim 4, wherein said impingement plate consists of polytetrafluoroethylene.

9. A metering apparatus according to claim 4, wherein said feed pipe includes means for laterally swinging said feed pipe out of the range of said impingement plate.

10. A metering apparatus according to claim 9, wherein said feed pipe is embraced by a free end of a swing lever rotatable about a vertical axis, a stop for said swing lever being provided for fixing the coaxial position of said feed pipe and said impingement plate.

11. A metering apparatus according to claim 1, wherein a broad-band nozzle of rectangular cross-section is provided at the end of said feed pipe, the lower end of said nozzle being arranged at a distance (A) from a horizontal rectangular impingement plate defining said converting means, said impingement plate causing the liquid to be directed outwardly perpendicularly to the longitudinal sides of said nozzle and the longitudinal sides of said impingement plate against two plane and vertical walls arranged on both sides of said impingement plate at a distance therefrom, a plurality of through orifices being provided side by side in said walls.

* * * * *